US007278860B2

(12) United States Patent
Ma

(10) Patent No.: US 7,278,860 B2
(45) Date of Patent: Oct. 9, 2007

(54) SOCKET CONNECTOR FOR CARRYING INTEGRATED CIRCUIT PACKAGE

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/288,817

(22) Filed: Nov. 28, 2005

(65) Prior Publication Data

US 2006/0116007 A1 Jun. 1, 2006

(30) Foreign Application Priority Data

Nov. 26, 2004 (TW) ..... 93219038 U

(51) Int. Cl.
*H01R 12/00* (2006.01)

(52) U.S. Cl. ..... 439/73

(58) Field of Classification Search ..... 439/73, 439/70–72, 342, 331, 876, 83; 29/860, 874; 257/778

See application file for complete search history.

(56) References Cited

U.S. PATENT DOCUMENTS 5,748,007 A * 5/1998 Gaschke ..... 324/755
5,834,848 A * 11/1998 Iwasaki ..... 257/778
6,196,871 B1 * 3/2001 Szu ..... 439/571
6,755,668 B2 * 6/2004 Copper et al. ..... 439/83
6,971,902 B2 * 12/2005 Taylor et al. ..... 439/342

FOREIGN PATENT DOCUMENTS

TW M249241 11/2004
WO WO90/06664 6/1990

* cited by examiner

*Primary Examiner*—Alexander Gilman
(74) *Attorney, Agent, or Firm*—Wei Te Chung

(57) ABSTRACT

A socket connector includes a metallic stiffener (12), an insulative housing (11), a load plate (14), a load lever (15) and a plurality of plastic supporting posts (16). The stiffener defines a central opening (120) in a middle portion thereof, the opening being surrounded by two pairs of inner surfaces (1201). The housing defines a recessed conductive zone (110) surrounded by sidewalls (111). The housing partially received in the opening of stiffener, and sidewalls interferentially engage with the inner surfaces in a direction parallel to the opening. The plastic supporting posts engage with the stiffener and are partially below the stiffener.

16 Claims, 7 Drawing Sheets

SOCKET CONNECTOR FOR CARRYING INTEGRATED CIRCUIT PACKAGE

BACKGROUND OF THE INVENTION

1. Field of the Invention

The invention relates to a socket connector, on which an LGA (land grid array) integrated circuit (IC) package is mounted.

2. Description of the Related Arts

Modern computer systems increase in performance and complexity at a very rapid pace, driven by intense competition and market demands. In order to meet ever-increasing performance requirements, the area and volumetric interconnect densities of electronic board assemblies must increase accordingly. In combination with other competitive forces, this demand has driven the need for improved high-density socket technologies in computer applications, and the connector industry has responded with a variety of new alternatives to meet these needs. One of the most attractive of the new connector types is the land grid array (LGA) socket connector, which permits direct electrical connection between an LGA integrated circuit and a printed circuit board. LGA socket connectors are an evolving technology in which an interconnection between mating surfaces of an IC or other area array device and a printed circuit board is provided through a conductive terminal received in the socket connector. Connection is achieved by mechanically compressing the IC onto the socket connector.

FIG. 12 shows a conventional socket connector for carrying an IC package thereon. The conventional socket connector 80 comprises a metallic stiffener 81, an insulative housing 82, a load plate 83 and a load lever 84.

The stiffener 81 defines a central opening 810 in a middle portion thereof, the opening 810 being surrounded by two pairs of ledges 811. The housing 82 defines a recessed conductive zone 820 surrounded by sidewall 821. The sidewalls 821 define a bottom surface 8210. A plurality of conductive terminals (not shown) is positioned in said recessed conductive zone 820. When the conventional socket connector 80 is assembled, the housing 82 is assembled with the stiffener 81, with the bottom surface 8210 seating on the ledges 811, and portions below the bottom surface 8210 through the opening 810.

While carrying an IC package (not shown), the socket connector is mounted on a printed circuit board (PCB, not shown) with tail ends (not shown) of the terminals being soldered with the PCB.

However, if there's a need to replace the stiffener for some reasons, it is really difficult, because the stiffener is suppressed by the housing, and the housing is relatively fixed on the PCB as the terminals being soldered on the PCB. In addition, the stiffener is very closed to the PCB, which will likely arouse short circuit of the PCB via the stiffener.

In view of the above, what is needed is a socket connector which can effectively prevent short circuit and can provide replaceable stiffener.

SUMMARY OF THE INVENTION

According to the present invention, an improved socket connector is provided to resolve the disadvantages described above. The socket connector comprises a metallic stiffener, an insulative housing, a load plate, a load lever and a plurality of plastic supporting posts. The stiffener defines a central opening in a middle portion thereof, the opening being surrounded by two pairs of inner surfaces. The housing defines a recessed conductive zone surrounded by sidewall. The housing partially received in the opening of stiffener, and sidewalls interferentially engage with the ledges in a direction parallel to the opening. The plastic supporting posts engages with the stiffener and are partially below the stiffener.

For the housing partially received in the opening of stiffener, and sidewalls interferentially engage with the ledges in a direction parallel to a plane, in which the opening is located, the stiffener can be removed from the housing in a direction toward the housing, which enables replace the stiffener without damaging the connector. Further more, while the connector is mounted on a PCB, parts of the posts below the stiffener can prevent the connection between the stiffener and the PCB, which enables preventing short circuit of the PCB.

Other advantages and novel features of the present invention will become more apparent from the following detailed description when taken in conjunction with the accompanying drawings, in which:

DESCRIPTION OF PREFERRED EMBODIMENT

Hereinafter, a preferred embodiment of the invention will be described in detail with reference to the attached drawings.

Figure 1:
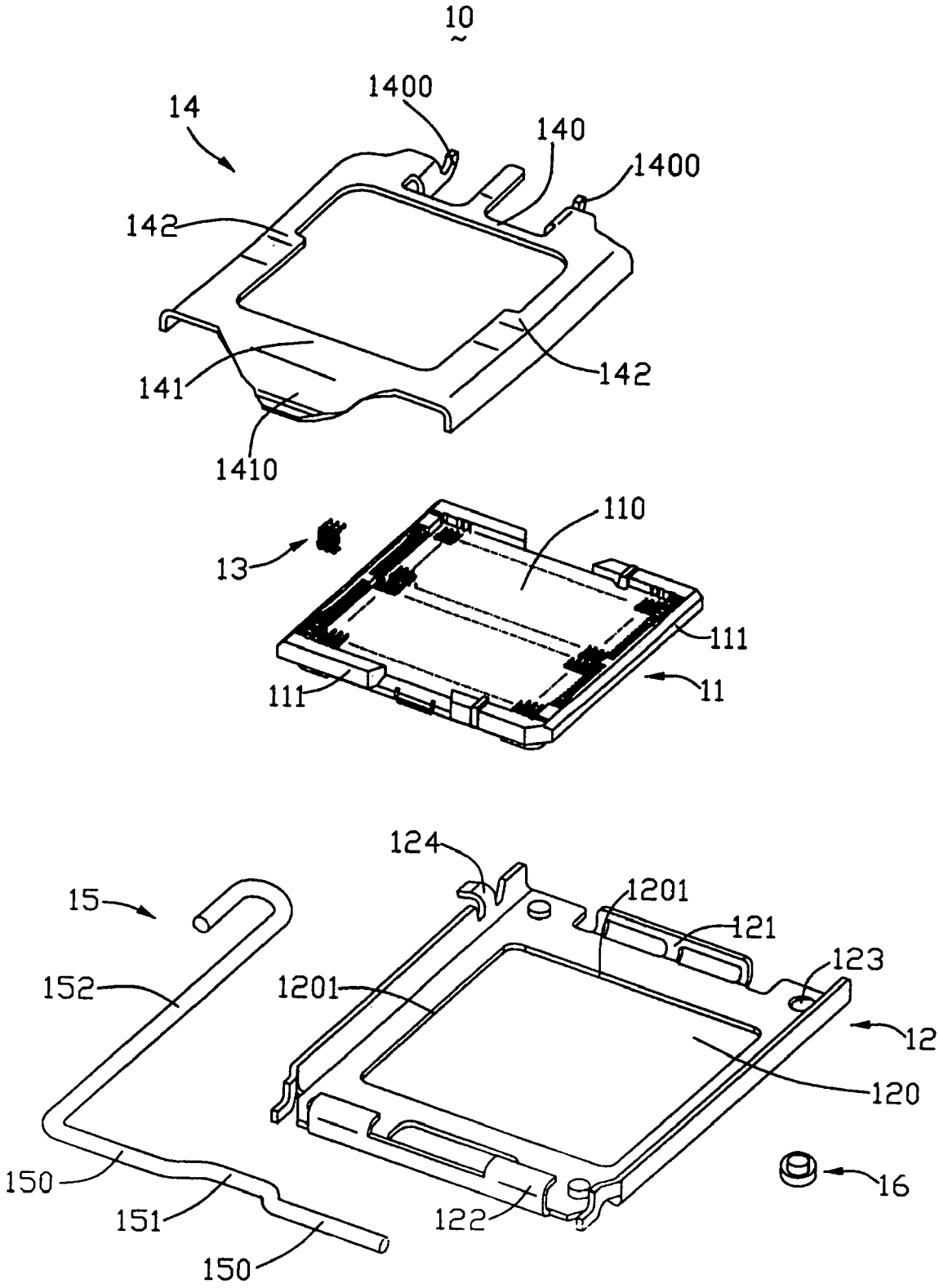
FIG. 1 is an exploded isometric view of a socket connector in accordance with a preferred embodiment of the present invention.
Figure 2:
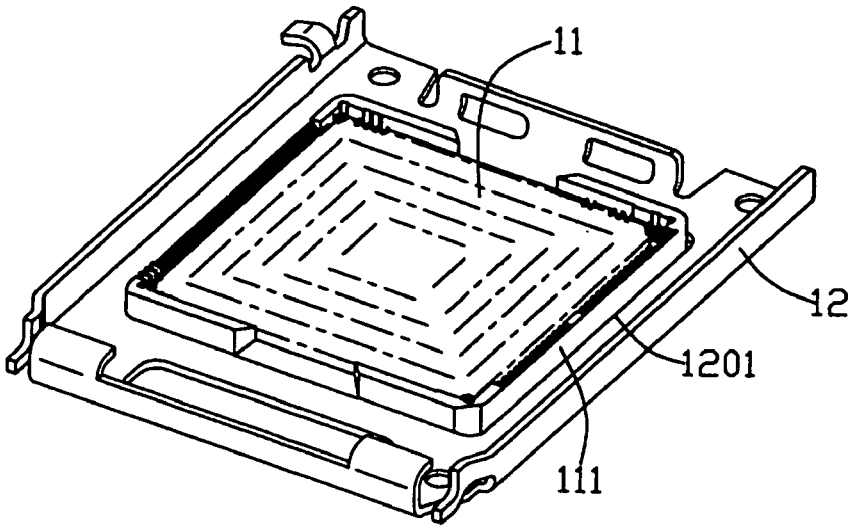
FIG. 2 is an assembled view of an insulative housing and a metallic stiffener of the socket connector.

Referring to FIGS. 1-2, an socket connector 10 for carrying an IC package (not shown) to be electrically connected to a PCB 20. The socket connector comprises an insulative housing 11, a metallic stiffener 12 engaging with the housing 11, a plurality of conducive terminals 13 received in the housing 11, a load plate 14 pivotally assembled to one end of the stiffener 12, a load lever 15 pivotally assembled to the stiffener 12, and a plurality of insulative supporting posts 16 attached to the stiffener.

The insulative housing 11 defines a recessed conductive zone 110 surrounded by two pairs of sidewalls 111. The terminals 13 are fixed in the conductive zone 110.

The metallic stiffener 12 is formed by stamping form a metallic sheet. The stiffener 12 defines an opening 120 in a middle portion thereof. The opening is generally rectangular and is surrounded by two pairs of inner surfaces 1201. The stiffener 12 defines a first end 121 and a second end 122 separated by the opening 120. A plurality of engaging holes 123 is arranged surrounding the opening in the stiffener. In this embodiment, the engaging holes 123 are arranged in four comers of the stiffener 12. The stiffener 12 further comprises a block 124 located close to the first end 121.

The load plate 14 is generally rectangular and includes a rear end 140, a front end 141 and two opposed pressing beams 142 connecting therebetween. The load plate 14 defines two spaced pivotal portions 1400 extending from the rear end 140 and an acting portion 1410 extending from the front end 141.

The load lever is generally L-shaped, and comprises a pivotal section 150, a pressing section 151 protruding from the pivotal section 150, and an operating section 152 extending form a distal end of the pivotal section 150.

Referring to FIG. 2, in assembly, the housing 11 assembles with the stiffener 12 by virtue of interference force between the sidewalls 111 of the housing and the inner surfaces 1201 of the stiffener 12. Thus, the stiffener 12 can be removed form the housing 11 upwardly or downwardly by proper exterior force.

Figure 3:
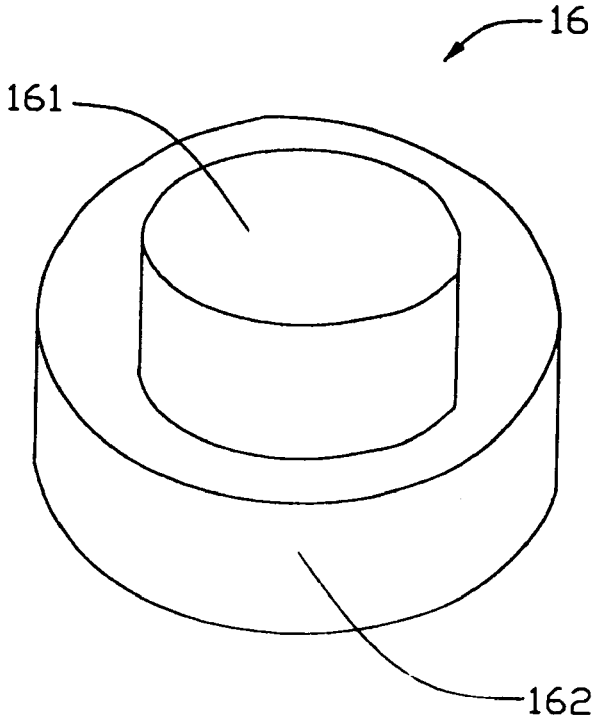
FIG. 3 is an isometric view of a plastic supporting post of the socket connector.
Figure 4:
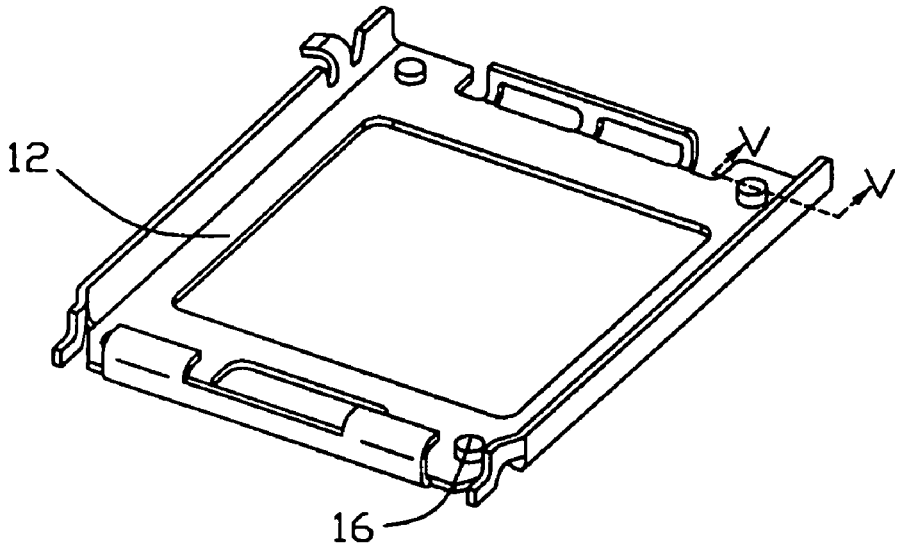
FIG. 4 is an assembled view of the stiffener and the supporting posts.
Figure 5:
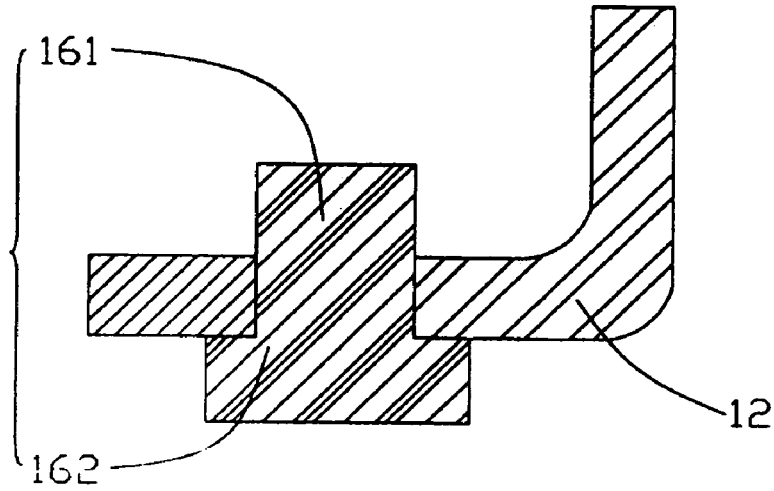
FIG. 5 is a cross-sectional view along line V-V in FIG. 4.

Referring to FIGS. 3-5, each of the plastic supporting posts 16 includes an upper post 160 and lower post 162, the lower post 162 being wider than the upper post 161. After the supporting post 16 is assembled with the stiffener 12, the upper post 161 interferentially engages with the engaging hole 123, and the lower post 162 is located below a bottom surface of the stiffener 12.

Figure 6:
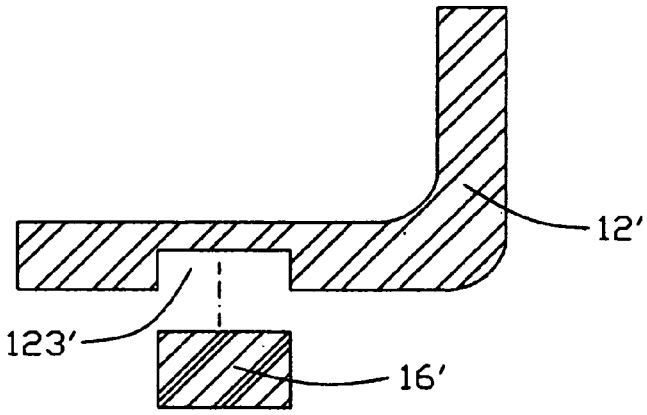
FIGS. 6-8 illustrate some assembling ways to engage the supporting posts and the stiffener.
Figure 7:
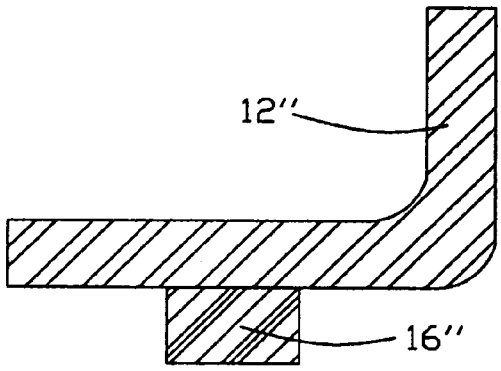
Figure 8:
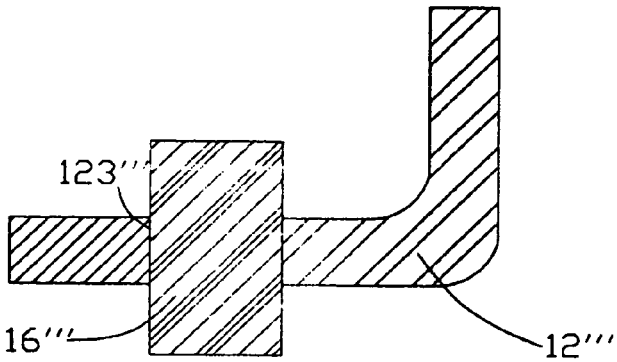

In this embodiment, the supporting post 16 is substantially T-shaped. In fact, there are some alternant ways to engage the supporting posts and the stiffener. FIGS. 6-8 show some alternant ways. FIG. 6 shows a stiffener 12' defining a recess 123' and a supporting post 16' fixed in the recess 123'. FIG. 7 illustrates a subassembly of a stiffener 12" and a supporting post 16" attached to a bottom surface of the stiffener 12". FIG. 8 displays a stiffener 12'" defining a through hole 123'" and a pillar-shaped supporting post 16'" interferentially engaging with the through hole 123'".

Figure 9:
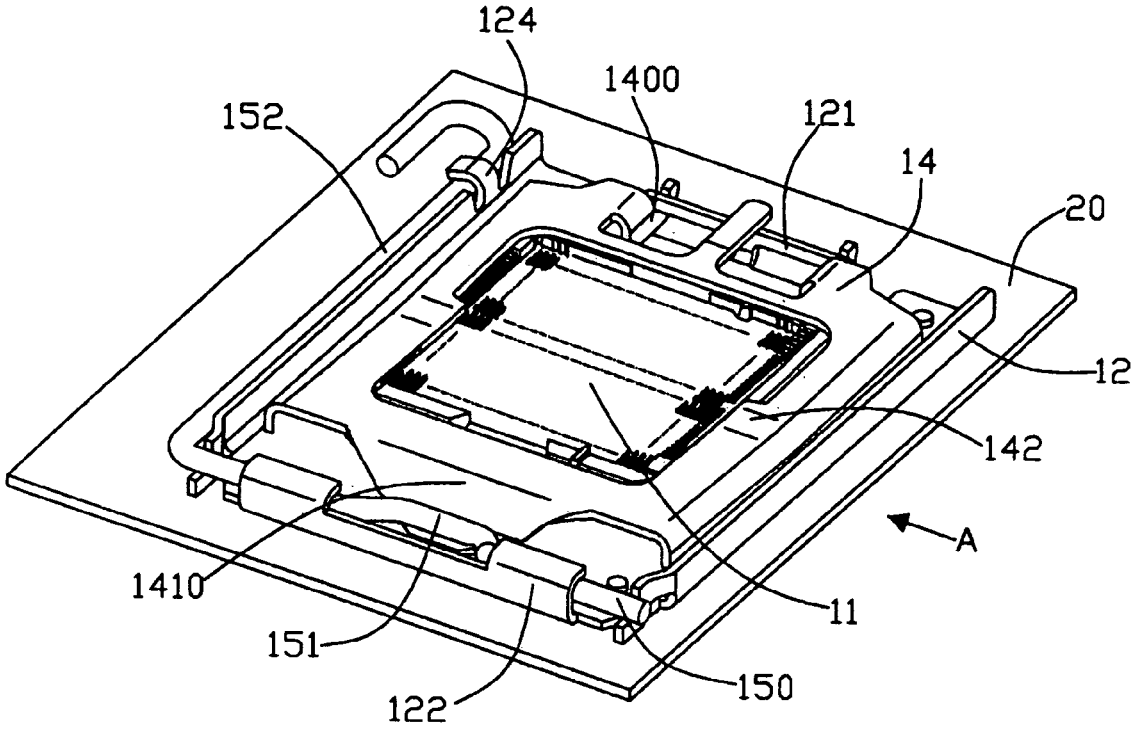
FIG. 9 is an assembled view of the socket connector, the socket connector being mounted on a printed circuit board.

Referring to FIG. 9, after the socket connector 10 is assembled, the pivotal portion 1400 of the load plate 14 is pivotally engaged with the first end 121 of the stiffener 12, and the pivotal section 150 is pivotally engaged with the second end 122 of the stiffener 12. When used, the socket connector 10 should be mounted on a PCB 20. After an IC package (not shown) is mounted on the housing 11, the pressing beams of the load plate 14 press on peripheral portions of the IC package, and the acting portion 1410 is suppressed by the pressing section 151 of the load lever 15. In order to stably fix the IC package in the connector, the operating section 152 is restricted by the block 124 of the stiffener 12.

Figure 10:
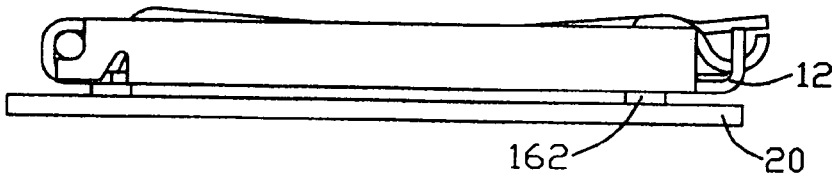
FIG. 10 is a side view of FIG. 9, along a direction A illustrated in FIG. 9.

FIG. 10 is a side view of FIG. 9 along Direction A. The lower post 162 is located between the bottom surface of the stiffener 12 and the PCB. Short circuit risk is accordingly avoided.

Figure 11:
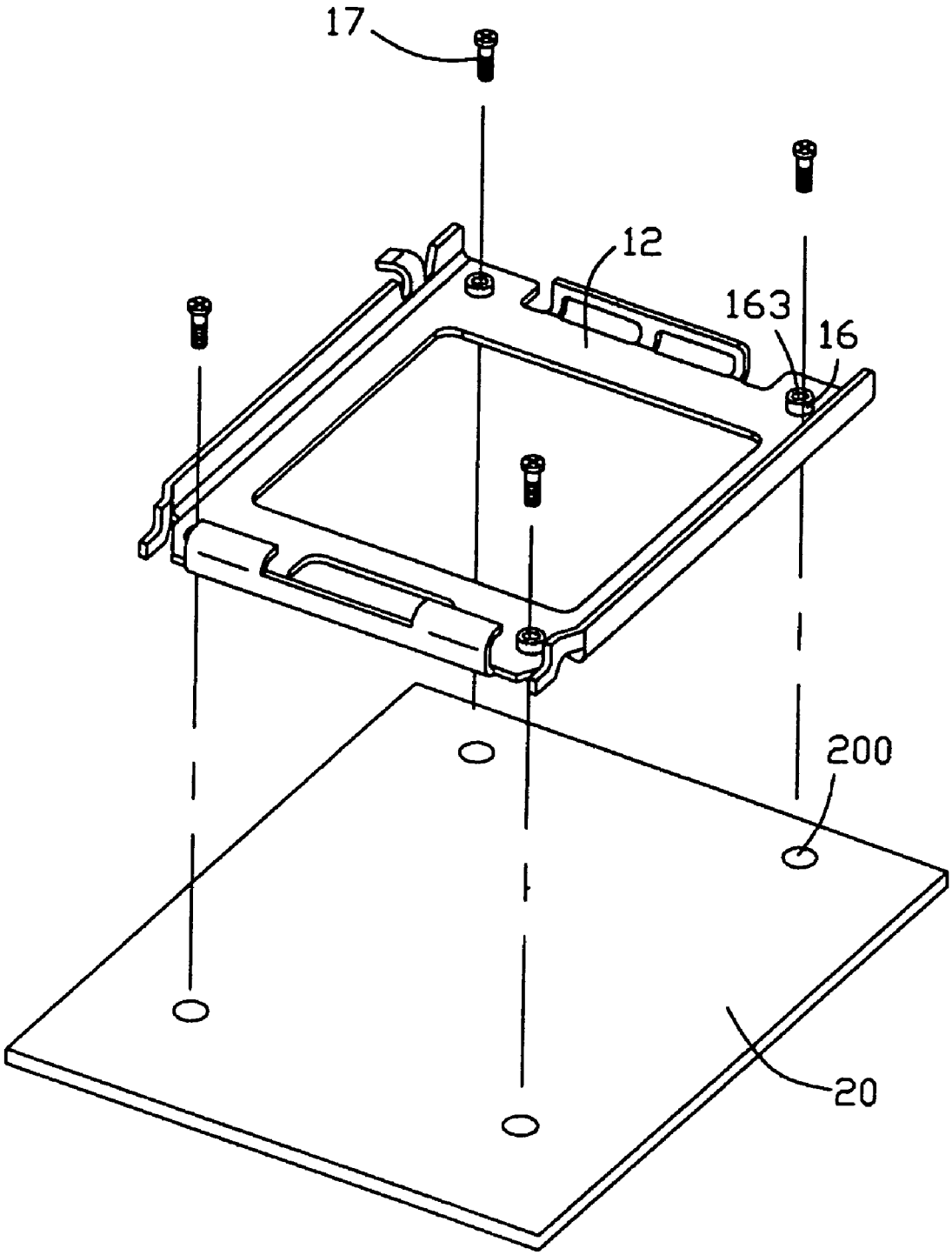
FIG. 11 is a second preferred embodiment in accordance with the present invention.
Figure 12:
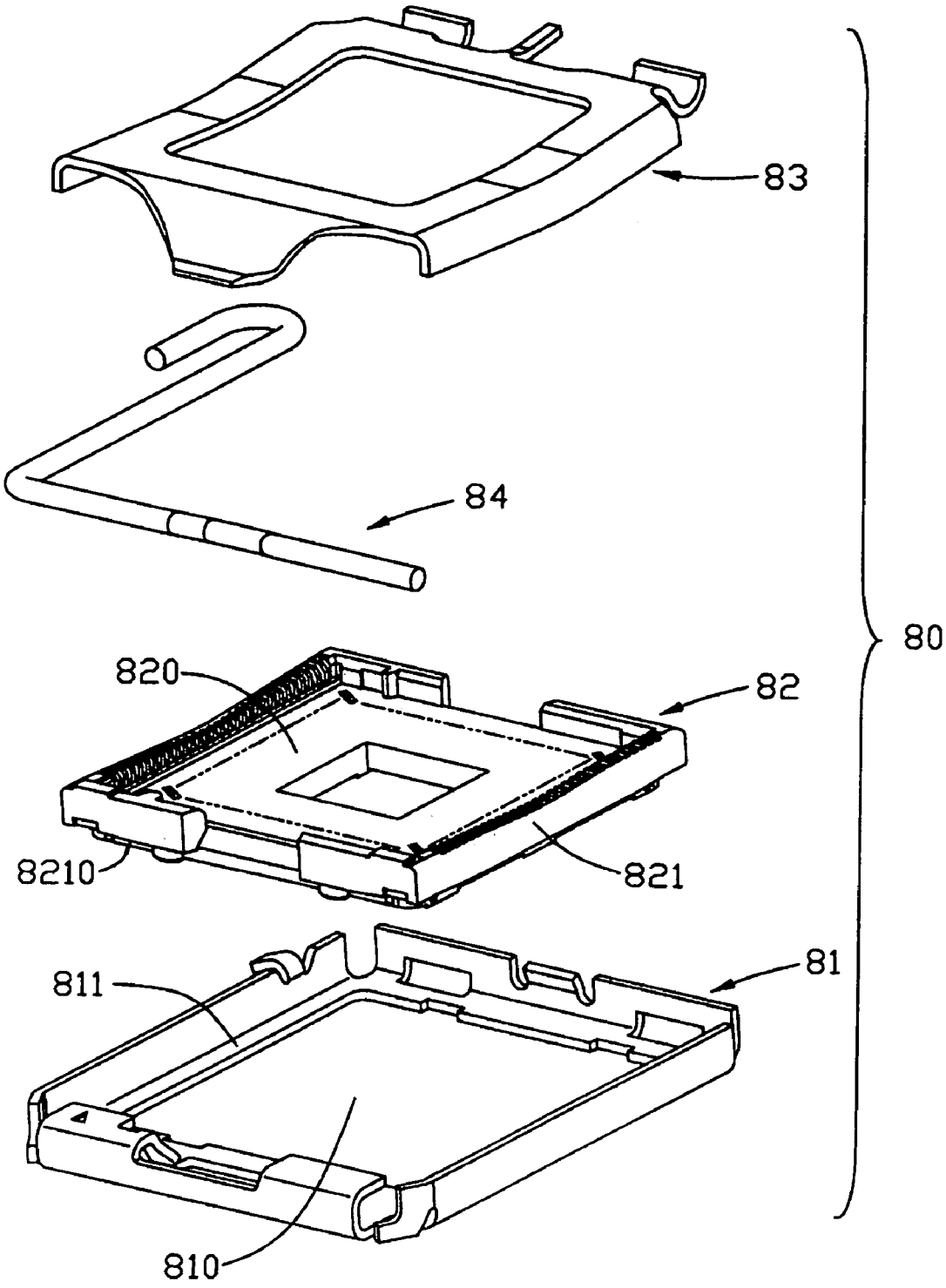
FIG. 12 (PRIOR ART)
FIG. 12 is an exploded isometric view of a conventional socket.

FIG. 11 illustrates a second embodiment of the present invention. Each of the supporting posts 16 is provided with a through channel 163. A plurality of screws 17 are provided to fix the stiffener 12 to the PCB by getting cross the through channel 163 and cooperating with whorls 200 in the PCB 20. Apparently, the screws can fix the stiffener to the PCB without crossing the supporting posts, e.g., crossing any hole without supporting posts.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A socket connector, for carrying an integrated circuit package, comprising:

an insulative housing defining a recessed zone surrounded by two pairs of sidewalls;

a plurality of conductive terminals received in the recessed zone;

a metallic stiffener defining an opening surrounded by two pairs of inner surfaces, the opening surrounding the housing;

a load plate pivotally assembled to a first end of the stiffener;

a load lever pivotally assembled to a second end of stiffener, the second end being opposed to the first end; wherein a plurality of plastic supporting posts is attached to the stiffener, and at least part of each plastic supporting post is below a most bottom surface of the stiffener; wherein the connector further comprises a plurality of screws assembled to the stiffener, wherein each of the supporting posts defines a through channel and the screws are partially received the through channels.

2. The socket connector as described in claim 1, wherein the sidewalls interferentially engage with the inner surfaces of the opening in the stiffener while allowing vertical movement therebetween under proper exterior forces.

3. The socket connector as described in claim 1, wherein the stiffener defines a plurality of recesses at a bottom surface thereof, and the supporting posts are partially fixed in the recesses.

4. The socket connector as described in claim 1, the supporting posts are attached to a bottom surface of the stiffener and are completely below the bottom surface.

5. The socket connector as described in claim 1, wherein the stiffener defines a plurality of engaging holes interferentially engaging with the supporting posts.

6. The socket connector as described in claim 5, wherein each of the supporting posts comprises an upper post and a lower post, the upper post being interferentially engaged with the engaging hole.

7. The socket connector as described in claim 6, wherein the lower post is wider than the upper post, and the lower post is below the most bottom surface of the stiffener.

8. A socket connector, for connecting an integrated circuit package to a printed circuit board, comprises:

an insulative housing defining a recessed zone surrounded by sidewalls;

a plurality of conductive terminals received in the recessed zone;

a metallic stiffener defining an opening surrounded by inner surfaces thereof;

a load plate pivotally assembled to a first end of the stiffener;

a load lever pivotally assembled to a second end of stiffener, the second end being opposed to the first end; wherein a plurality of plastic supporting posts is attached to the stiffener, and at least part of each plastic supporting post extends downwardly below the stiffener so as to be located between the printed circuit board and the stiffener, thus supporting the stiffener and preventing the stiffener from contacting the printed circuit board, further comprising a plurality of screws assembled to the stiffener; wherein each of the supporting posts defines a through channel and the screws are partially received the through channels.

9. The socket connector as described in claim 8, wherein the housing is received within the opening, and the sidewalls interferentially engage with the inner surfaces of the stiffener.

10. The socket connector as described in claim 8, wherein the stiffener defines a plurality of recesses at a bottom surface thereof, and the supporting posts are partially fixed in the recesses.

11. The socket connector as described in claim 8, the supporting posts are attached to a bottom surface of the stiffener and are wholly below the bottom surface.

12. The socket connector as described in claim 8, wherein the stiffener defines a plurality of engaging holes interferentially engaging with the supporting posts.

13. The socket connector as described in claim 12, wherein each of the supporting posts comprises an upper post and a lower post, the upper post being interferentially engaged with the engaging hole.

14. The socket connector as described in claim 13, wherein the lower post is wider than the upper post, and the lower post is located between the stiffener and the printed circuit board.

15. An socket connector assembly comprising:

a printed circuit board;

a socket connector seated upon the printed circuit board and including:

an insulative housing;

a plurality of conductive terminals received in the housing, each of the terminals defining an upper contact portion for engagement with an electronic component, and a lower tail soldered with the printed circuit board;

a metallic stiffener assembled with the housing; wherein a plurality of plastic supporting posts are engagably sandwiched between the printed circuit board and the stiffener so as to support the stiffener and prevent the stiffener from contacting the printed circuit board; wherein the plastic supporting posts are immovably fastened to the stiffener while the housing is vertically moveable relative to the stiffener before being mounted to the printed circuit board.

16. The socket connector assembly as claimed in claim 15, wherein said stiffener is fastened to the printed circuit board by means other than securement between the terminals and the printed circuit board.

* * * * *